US010202816B1

(12) United States Patent
Stierwalt

(10) Patent No.: US 10,202,816 B1
(45) Date of Patent: Feb. 12, 2019

(54) APPARATUS AND METHOD OF MANUFACTURE FOR RETROFITTABLE CONTAINMENT CELLAR

(71) Applicant: Mikel R. Stierwalt, Shidler, OK (US)

(72) Inventor: Mikel R. Stierwalt, Shidler, OK (US)

( * ) Notice: Subject to any disclaimer, the term of this patent is extended or adjusted under 35 U.S.C. 154(b) by 0 days.

(21) Appl. No.: 15/669,312

(22) Filed: Aug. 4, 2017

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 21/01
USPC ..... 175/211; 166/337
See application file for complete search history.

(56) References Cited

U.S. PATENT DOCUMENTS

| | | | | |
|---|---|---|---|---|
| 1,258,839 | A | 3/1918 | Wheeler | |
| 1,448,243 | A * | 3/1923 | Wilson | E21B 33/08 166/81.1 |
| 1,712,510 | A | 5/1929 | Monie | |
| 3,202,217 | A | 8/1965 | Watts et al. | |
| 4,335,740 | A | 6/1982 | Boley | |
| 4,416,328 | A | 11/1983 | Baski | |
| 4,696,330 | A | 9/1987 | Raudman et al. | |
| 4,717,036 | A | 1/1988 | Dundas et al. | |
| 4,842,443 | A | 6/1989 | Argandona | |
| 5,098,220 | A | 5/1992 | Norman | |
| 5,114,271 | A | 5/1992 | Sunderhaus | |
| 5,228,506 | A | 7/1993 | Pearce | |
| 5,377,748 | A * | 1/1995 | Gayaut | E21B 21/01 166/162 |
| RE35,272 | E | 6/1996 | Mathieson et al. | |
| 5,535,556 | A | 7/1996 | Hughes, Jr. | |
| 7,637,692 | B1 | 12/2009 | Rose | |
| 7,770,333 | B2 | 8/2010 | Meyers | |
| 7,966,786 | B2 | 6/2011 | Koteskey | |
| 7,987,904 | B1 | 8/2011 | Rose | |
| 8,127,837 | B1 | 3/2012 | Rose | |
| 8,256,505 | B1 | 9/2012 | Rose | |
| 8,485,250 | B1 | 7/2013 | Rose | |
| 9,175,550 | B2 * | 11/2015 | Dunlavy | E21B 43/0122 |
| 9,435,435 | B2 | 9/2016 | Gavin | |
| 2003/0051882 | A1 | 3/2003 | Hitchon | |
| 2007/0031190 | A1 | 2/2007 | Meyers | |

(Continued)

OTHER PUBLICATIONS

Wikipedia; "File: Welhead-dueal completion.jpg", retrieved on Jun. 19, 2017 from https://it.wikipedia.org/wiki/File:Wellhead-dual_completion.jpg.

(Continued)

*Primary Examiner* — David J Bagnell
*Assistant Examiner* — Yanick A Akaragwe
(74) *Attorney, Agent, or Firm* — Robert H. Frantz

(57) ABSTRACT

A modular well containment cellar system having a bottom portion, two co-planar half-panels joined to the bottom portion and separated by a through-channel portion, and a one side wall joined to a bottom portion and to the half-panels, forming a closed container with an open top for mating to another cellar component at the half-panels, wherein a well pipe may be received into the through-channel. A plurality of drip diverters prevent downward-moving liquid from running between the mated half-panels and between the well pipe and the through-channel, to capture dripped and running liquids from above the containment cellar system.

17 Claims, 7 Drawing Sheets

(56) References Cited

U.S. PATENT DOCUMENTS

2011/0259602 A1 10/2011 Britton

OTHER PUBLICATIONS

Upstream Pumping; "Wellhead Oil Spill Prevention Challenges Production"; retrieved on Jun. 19, 2017 from http://www.upstreamepumping.com.
Bing; search result for "oil well wellhead" image; retrieved on Jun. 19, 2017 from http://www.bing.com/images/search?view=detailV2&ccid=XphzHalz&id=627B4C86DE72CCFE5B5CE4EOCADF4AAADCE9D566&thid=OIP.XphzHalzEVpknT-g3YcsVgEsDh&q=oil+well+head&simid=607996740311976370&selectedIndex=0&ajaxhist=0.
Adoil; Titan Containment; retrieved on Jun. 19, 2017 from http://adoil.net/titan-containment/.
Osha; "Cellar" definition; retrieved on Jun. 15, 2017 from https://www.osha.gov/SLTC/etools/oilandgas/Illustrated_glossary/cellar.html.
Definedterm; "Cellar" definition, retrieved on Jun. 15, 2017 from https://definedterm.com/a/definition/193893.
Cellar Tech; "Containment Cellars", retrieved on Jun. 15, 2017 from http://cellartech.com/containment-well-cellars/.
Cellar Tech; "Containment Well Systems", retrieved on Jun. 15, 2017 from http://cellartech.com/wp-content/uploads/2016/07/Cellar-Tech-Well-Cellar-Presentation.pdf.
Cellar Tech; Containment Well Cellar Installation; retrieved on Jun. 15, 2017 from http://cellartech.com/well-cellar-Installation/.
Iadc Lexicon; "Cellar" definition; retrieved on Jun. 15, 2017 from http://www.iadclexicon.org/cellar/.
Croft Systems; The Difference Between a Wellhead & Christmas Tree; retrieved on Jun. 15, 2017 from https://www.croftsystems.net.
OGPE; "Oil, gas well cellars / trenches access wellhead equipment"; May 31, 2011.

* cited by examiner

APPARATUS AND METHOD OF MANUFACTURE FOR RETROFITTABLE CONTAINMENT CELLAR

FIELD OF THE INVENTION

The invention generally relates technologies to contain leakage and small-scale spills from well heads and "Christmas tree" assemblies.

BACKGROUND OF INVENTION

Well heads for oil and gas wells are often topped by a plurality of system components, such as blow out preventers, gauges, and valves atop the production casing. The combination of components mounted atop the well head is often referred to as a "Christmas tree", or "tree" for short. The junction between the well head and the tree may be just above ground level, at ground level, or slightly below ground level.

Many of these connections and components may leak some oil, salt water, or often a combination of both. This leakage may drip, run or fall onto the ground surrounding the well head, causing environmental damage, danger to nearby wildlife and livestock, and hazards for the crew working on the well site. It is impractical to prevent all drips and leaks, especially on older wells which are subjected to a variety of corrosive forces as well as vibration from pump motors. So, many well are provided with containment cellars, which are generally lined pits formed around the well head with a sufficient diameter to catch the drips, runs and leaks. The containment cellars are often provided with a permeable bottom, such as gravel, 6' to 10' below ground level, which allows the leaking oil and salt water to seep back down into the ground, well below ground level, thereby preventing the environmental damage and hazards. The top of these containment cellars are often provided with a grate to prevent animals and crew members from falling into the pit, but through which the leaking liquids can readily pass.

SUMMARY OF THE INVENTION

A modular well containment cellar system having a bottom portion, two co-planar half-panels joined to the bottom portion and separated by a through-channel portion, and a one side wall joined to a bottom portion and to the half-panels, forming a closed container with an open top for mating to another cellar component at the half-panels, wherein a well pipe may be received into the through-channel. A plurality of drip diverters prevent downward-moving liquid from running between the mated half-panels and between the well pipe and the through-channel, thus avoiding need for sealants or gaskets between the mated panels, the through-channel and the well pipe, to capture dripped and running liquids from above the containment cellar system.

BRIEF DESCRIPTION OF THE DRAWINGS

The description set forth herein is illustrated by the several drawings.

DETAILED DESCRIPTION OF EMBODIMENT(S) OF THE INVENTION

Figure 1:
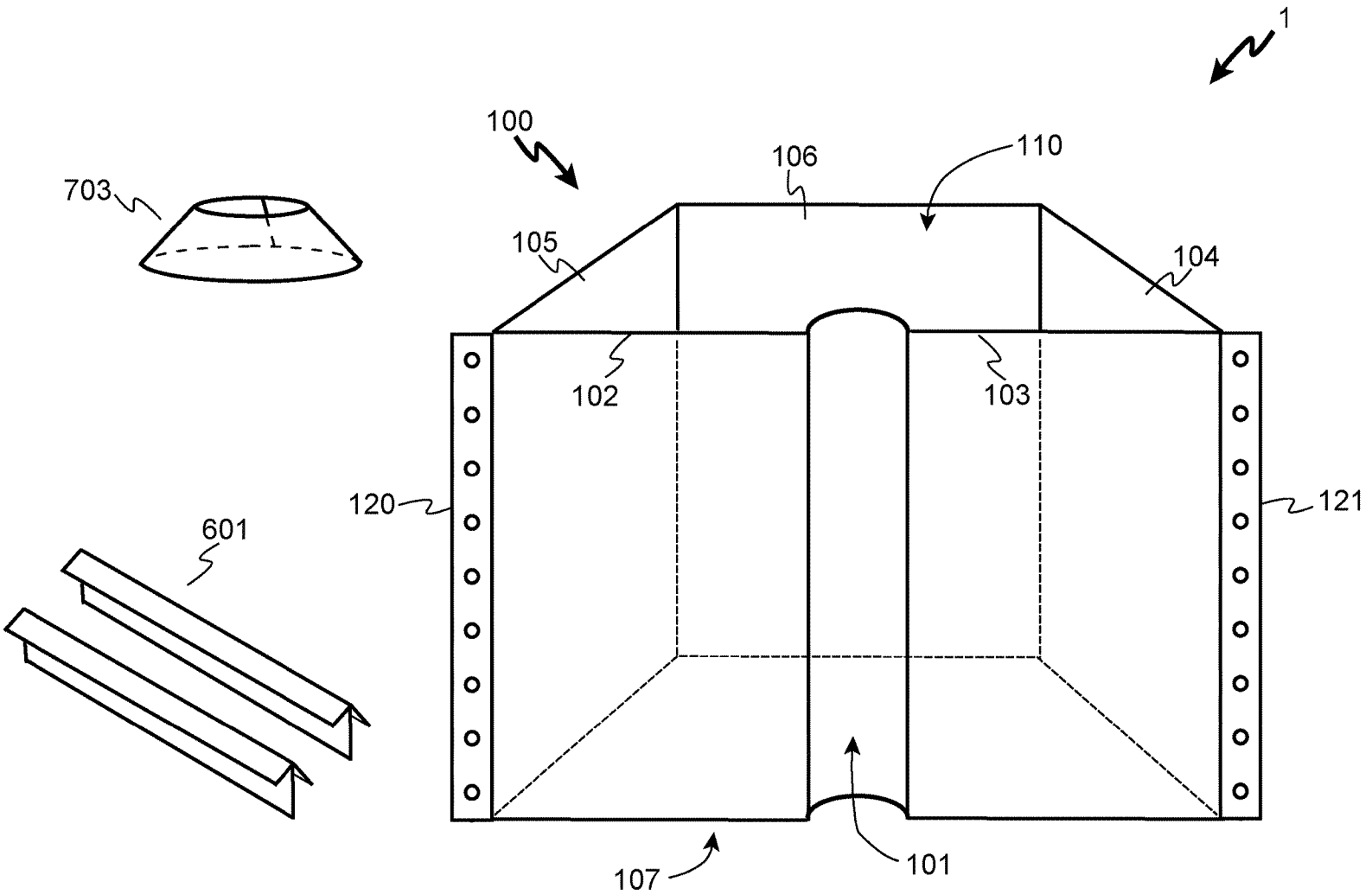
FIG. 1 illustrates a component kit of a rectangular retrofittable containment cellar according to at least one embodiment of the present invention.

The inventor of the present invention have recognized problems in the art not previously recognized or addressed in the art of fabrication, construction and installation of containment cellars for well heads and the associated well-top components (valves, gauges, blow-out preventers, fittings, joints, etc.). In one known manner of providing a containment cellar, the foresight of needing or wanting a cellar in advance of installing the well-top components must be had so that a pit can be dug around the well head, and a single, continuous circular topless and bottomless can-shaped steel pre-fabricated wall can be lowered over and around the production pipe into the pit. Then, dirt is replaced around the outside of the wall, gravel is dumped into and spread at the bottom of the pit inside the wall, and optionally a grate is placed across the top of the open pit.

This process, however, is not conducive to retrofitting an operating well because the pre-fabricated can-shaped continuous wall unit does not fit over the well-top components (tree, BOPs, etc.). So, to use this method of creating a containment pit after the well is in production, the well must be capped, the well-top components removed, the wall and pit installed, well-top components re-installed, and the well uncapped. However, once a well is in operation and producing oil or gas, it is costly and risky to stop its flow for any period of time, partly because of the loss of revenue of the product not pumped during the shutdown, and party due to the risk that the well will not return to its previous flow rate. Further, even when this containment cellar approach is used in advance of a well going into production, it still provides a bottom which allows the leaked fluids to return to the ground, potentially contaminating ground water, and resulting in lost revenue for not capturing the leaked product.

Another method of creating a containment cellar, especially in a producing well, is to leave the components above the wellhead in place and the well in production, and then to carefully excavate a pit around the well head. Then, forms are constructed for walls for the cellar, and concrete is poured into the forms. After the concrete has cured, the forms may be removed, gravel may be dumped and spread into the bottom of the pit, and a grate may be placed over the pit. This method can be more expensive than using the pre-formed continuous wall system because the construction site is often remote and/or secluded, and it shares the other drawbacks regarding ground water contamination and lost revenue from the leaked fluids.

Yet another method of creating a containment cellar includes using pre-formed cellar components that must be fitted around a well pipe, and sealed to the well pipe using sealants and/or gaskets. The present inventor has realized that these sealants and gaskets may fail, especially during shifting and settling of the dirt around the cellar, and may also pose a difficulty when needing to remove the cellar, well pipe, or both. And, in known configurations, the exterior of the well pipe is exposed to the corrosive fluids which are captured in the cellar, leading to future maintenance requirements that can be costly and require a risky shut down and restart of the well flow.

The present inventor has recognized these shortcomings in the art of containment cellars, and has devised a method and a plurality of components for a full containment cellar which is retrofittable to a production well in a manner that allows the well to remain in production during installation of the cellar components, and which allows for capture of the leaked fluids. Further, according to at least one embodiment, the exterior of the well pipe is encased and protected by walls of the new modular cellar design to prevent the well pipe from being corroded by the captured fluids. These and other objectives and advantages of the present invention will become evident to the reader in the following paragraphs.

Basic Containment Cellar Kit

Referring to FIG. 1, a kit (1) of components according to at least one embodiment of the present invention is shown, including two or more containment components (100), two or more diverter ridge caps (601), and at least one diverter cone (703). The containment components are provided with a means for attaching them to each other, such as a set of flanges (120, 121) with holes for nuts and bolts.

Containment Components

Figure 2:
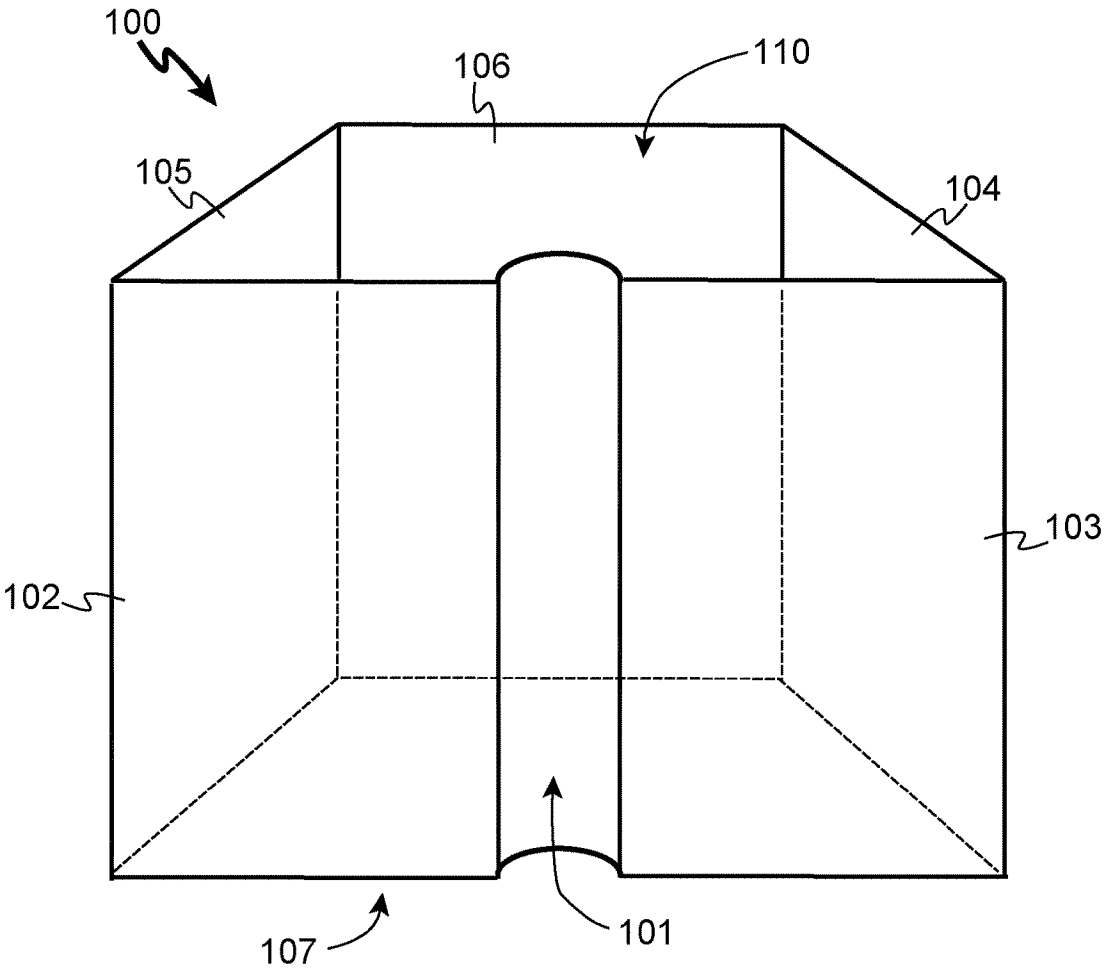
FIG. 2 provides mating-side view of a simplified illustration of key portions of one container component of a rectangular retrofittable containment cellar according to at least one embodiment of the present invention.

FIG. 2 shows a simplified structure for one embodiment of a containment component (100) according to the present invention, which as generally rectangular in shape, having a bottom (107), two half panels (102, 103) with a through-channel (101) formed between the half panels and the bottom (107), two side panels (104, 105), and a panel (106) juxtaposed to the through-channel (101). These sides and the bottom form a closed container with an open top (110) for receiving dripped liquids.

Figure 3:
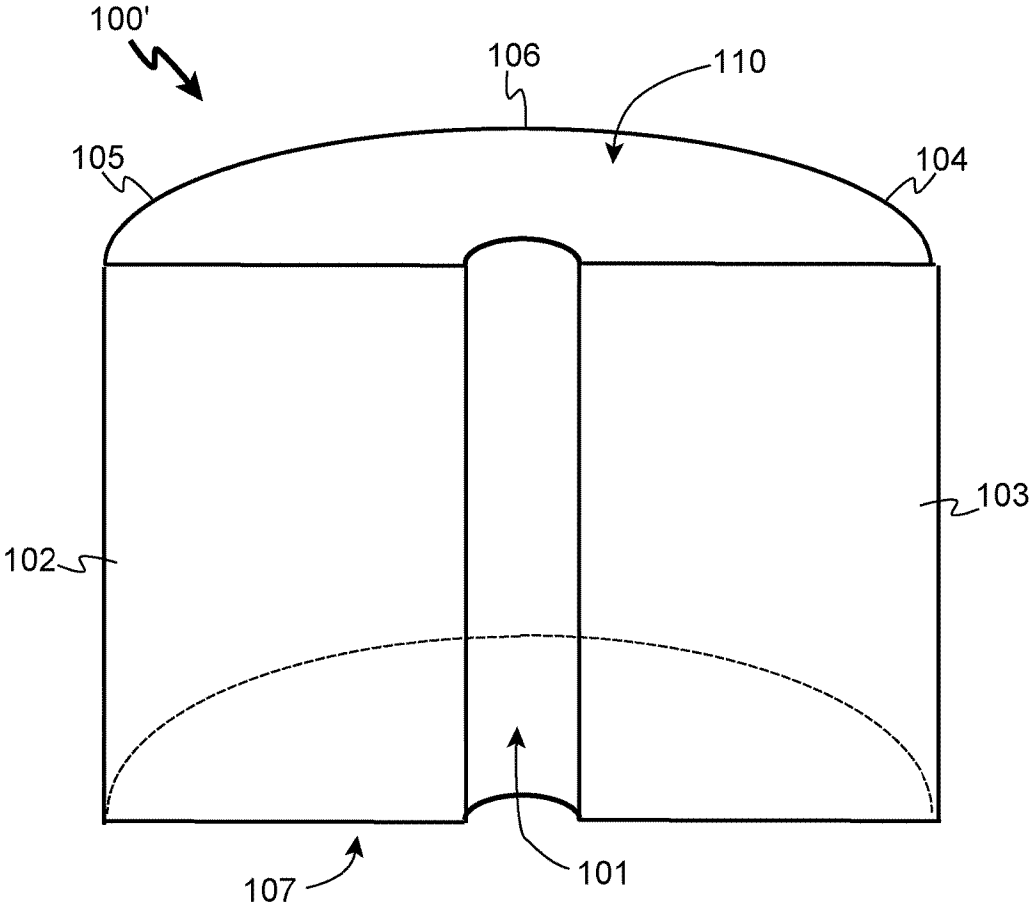
FIG. 3 depicts mating-side view of a semi-cylindrical embodiment container component of a retrofittable containment cellar according to at least one embodiment of the present invention.

FIG. 3 illustrates another embodiment according to the present invention of a containment component (100') which is semi-circular in shape, having a bottom (107), two half panels (102, 103) and a through-channel (101), a one continuous curved side represented at three points (104, 105 and 106) for orientation in the following discussions, and an open top (110).

Mating of Containment Components

Figure 6:
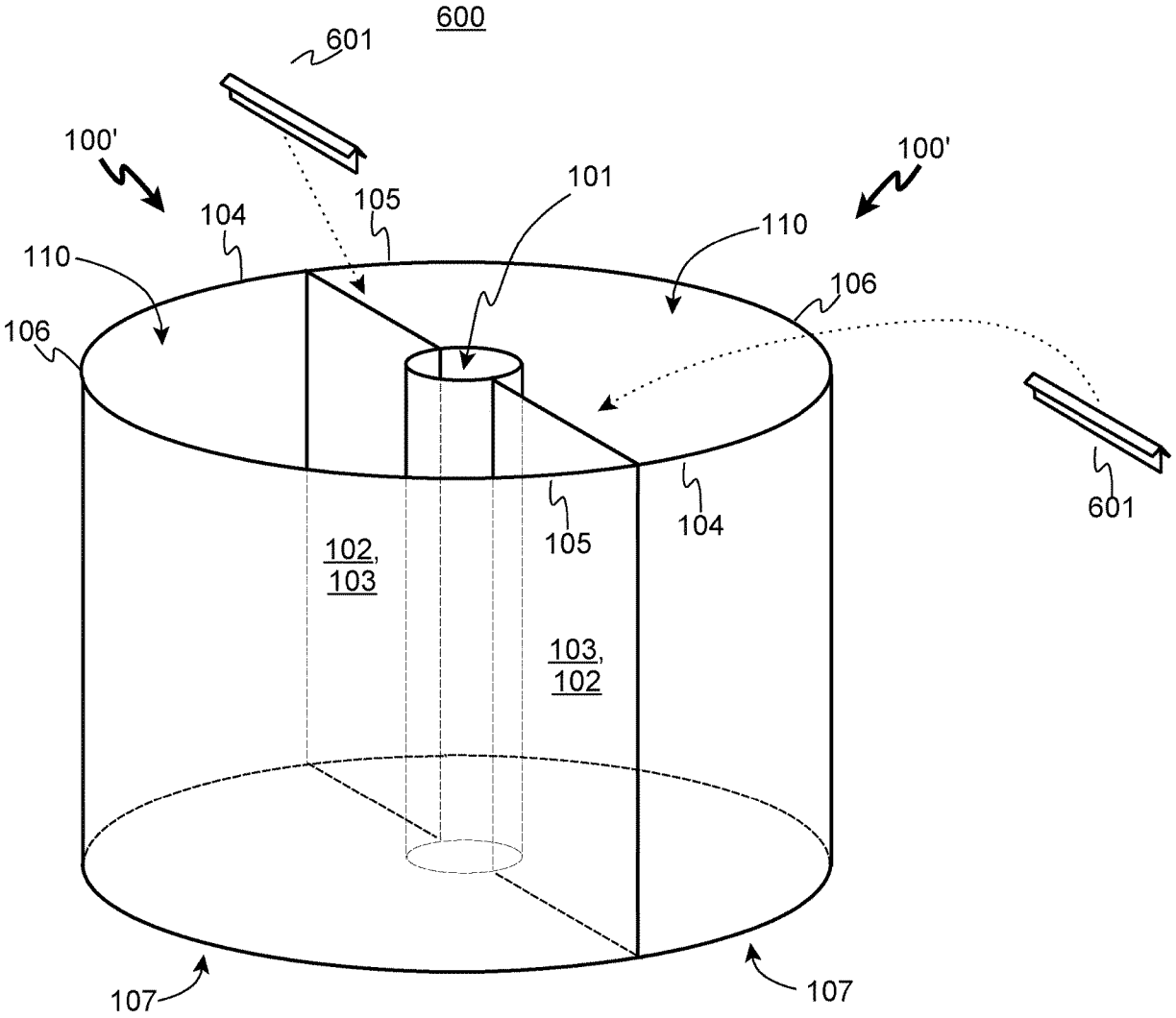
FIG. 6 illustrates a perspective view of a retrofittable containment cellar according to the present invention, including two ridge caps and two matted container components.

For installation without having to remove well head well-top components, two or more of the containment components are placed into an excavated pit with the half panels (102, 103) mated towards each other, as shown in FIG. 6. The production pipe is captured in the through-channels (101) of the two or more containment components (100'), and the containment components are secured to each other, such as by fixing bolts and nuts through flanges as earlier shown in FIG. 1. In this manner, any fluid which is dripped from the components or fittings above the top of the containment system (600) may be received into the open tops (110). Additionally, because the production pipe is actually encased between the walls of the containment components, the production pipe is not exposed to the captured fluids, thereby protecting against corrosion of the production pipe.

However, some fluid may drip on top of the mated half-panels (102, 103), and could potentially run down between the half-panels such that it is not captured within the containment components (100'). Optionally, to prevent this loss of fluids, ridge caps (601) may be placed between the opposing and mated half-panels (102, 103), to divert this portion of the leaked fluids into one of the two (or more) containment components (100').

Installation of Containment System

Figure 7:
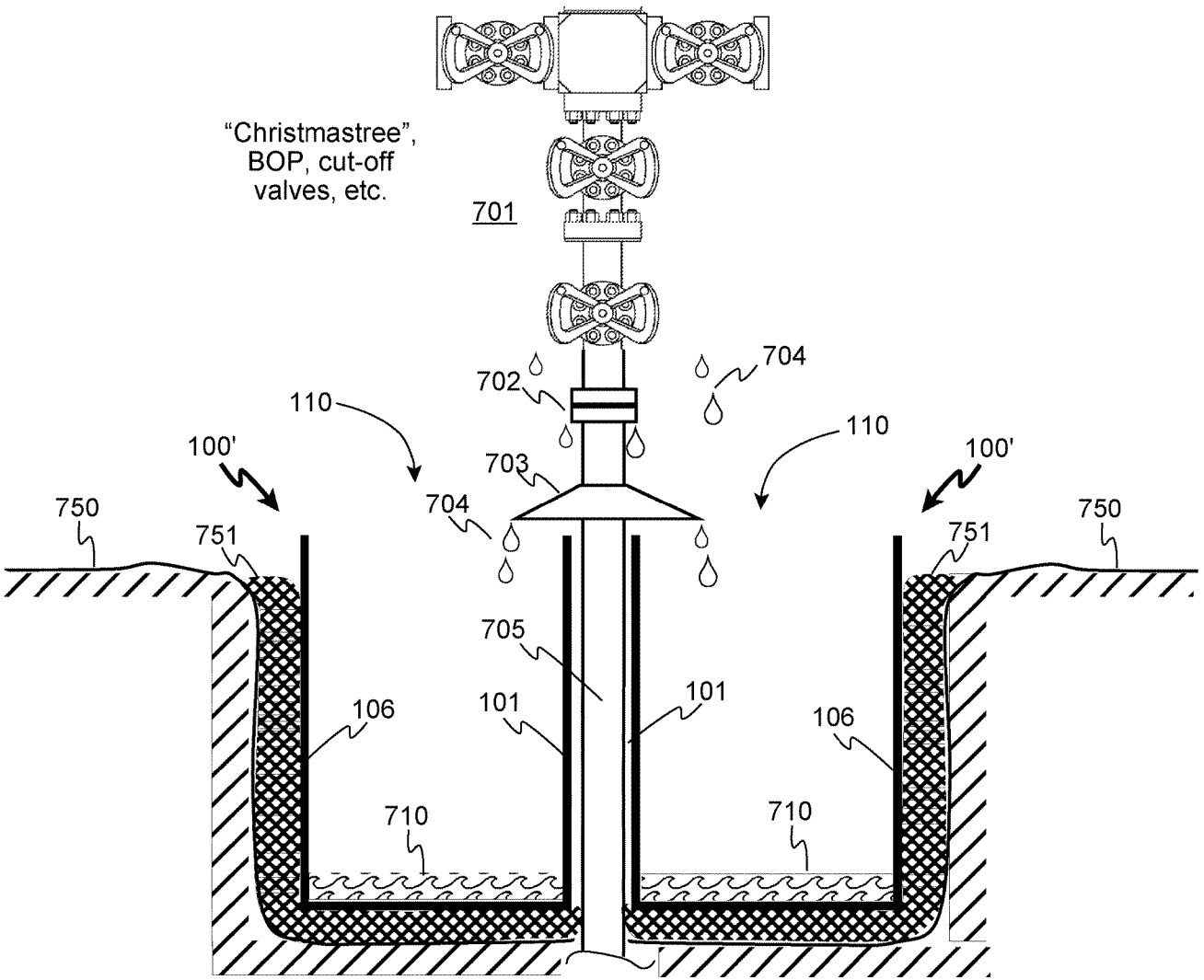
FIG. 7 provides an installed cut-away view of at least one embodiment of the present invention as installed, with a drip diverter component.

FIG. 7 shows a cut-away view of at least one embodiment of the present invention as installed, wherein the cut-away is taken through the production pipe (705) and the containment components (100' or 100). The well-top components (701) and pipe fittings (702) may drip fluids (704), some of which may fall directly into one of the containment component's open tops (110). Some of the leaked fluid may run down the pipe or drip close to the pipe, which is optionally diverted into the open tops (110) by a diverter cone (703) as shown.

To install the containment cellar system without shutting down the well or removing any of the well-top components (701), dirt (750) is excavated away from around the well head production pipe (705) a sufficient distance and depth to receive the two or more containment components (100' or 100). The depth of the excavation may be sufficient that the tops of the containment components (100 or 100') are essentially flush with ground level, or even above ground level to prevent surface water from entering the cellar.

Prior to dropping the containment components (100 or 100') into the excavated pit, preferably a levelling material such as sand or gravel is placed in the bottom of the pit. After the containment components have been maneuvered to capture the well pipe in the through-channel, and the containment components have been secured to each other, the excavated pit is back filled (751) around the outside walls (104, 105, 106) of the containment components to provide back pressure against the weight of accumulated fluids (710).

Optionally, a grate may be placed over the open tops (110) of the containment components for safety.

Reclamation of Accumulated Fluids

There are a number of methods to reclaim the fluids which are accumulated into the containment system. First, a pumper truck may be used by placing a drawing tube into the bottom of the containment components, and the accumulated fluid (710) pumped out of the cellar and into the truck. Another method would be to fit a drain pipe or tube at the bottom of the containment components which is then run to an accumulation tank, battery, or separator unity. And, another method would be to remove the containment components from the pit with the liquid in them, place them on the back of a truck, and install empty containment components in their place.

Through-Channel Bump-Out(s)

Figure 4:
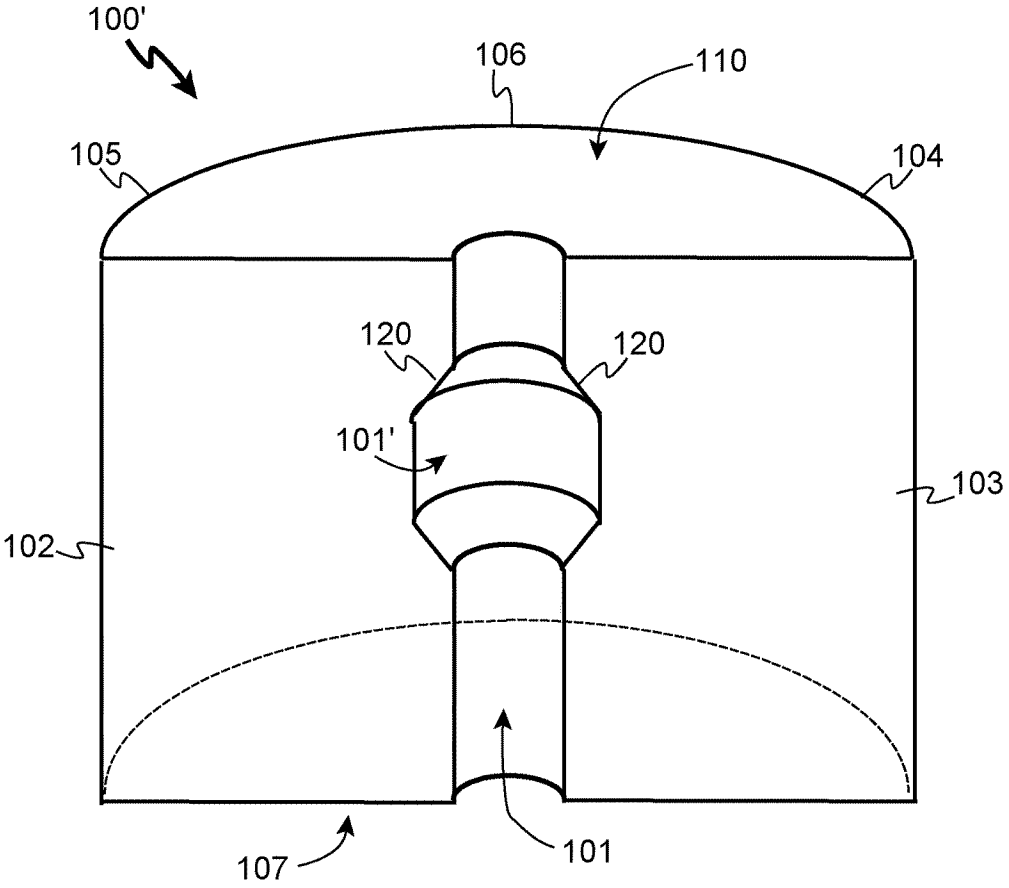
FIG. 4 shows mating-side view of a variation of the embodiment of FIG. 3 with an optional "bump out" to accommodate pipe fittings, joints, or system components within the through-channel of a retrofittable containment cellar according to at least one embodiment of the present invention.
Figure 5:
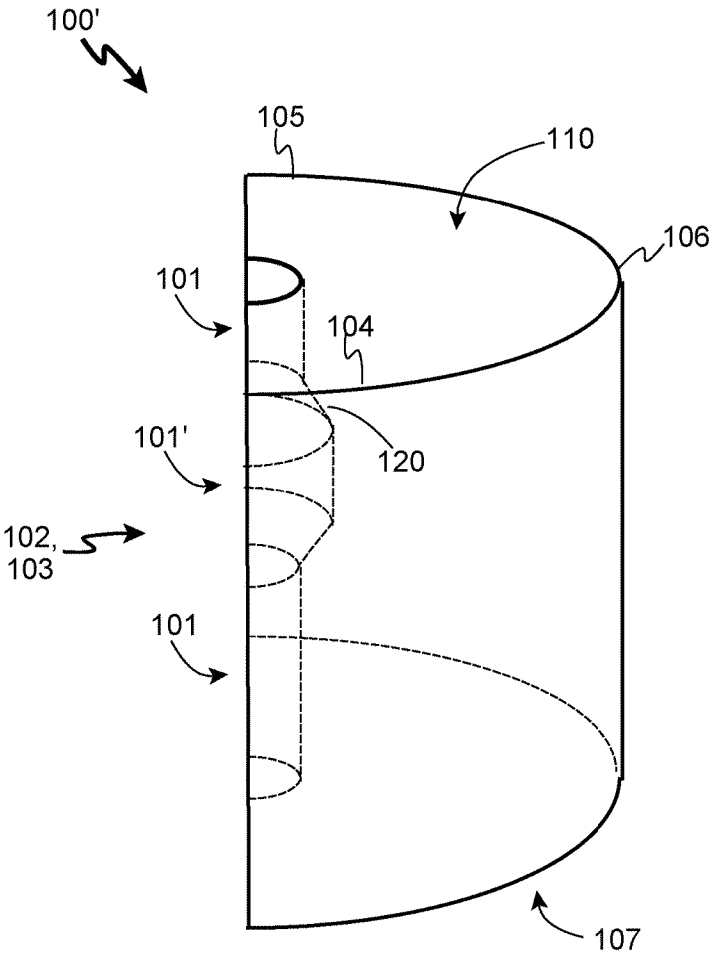
FIG. 5 provides a non-mating-side view of the embodiment of FIG. 4, including the bump out structure in the through-channel.

In the previously-discussed drawings, the through-channels (101) were shown essentially cylindrical of consistent radius from bottom to top of the container component (100, 100'). However, in some applications, there may be flares in the channel needed to accommodate components, joints, etc., in the pipe which is captured in the through-channel, so a bump-out (101') may be formed in the through-channel (101) as shown in FIG. 4 and FIG. 5. These larger-radius portions within the through-channel may be provided with a sloped top (120) to prevent possible pooling of liquids which may be running down the inside of the through-channel above the bump-out (101'). Other embodiments may include multiple bump-outs, or bump-ins (smaller radius portions of the through-channel), etc.

Submerged, Off-Short and Suspended Embodiments

The containment components can, in some embodiments, be fully submerged for off-shore applications. And, with the addition of a mounting flange above which the production pipe on which the two (or more) containment components may rest, a containment system can be built entirely above ground level (or water level), suspended only by the production well pipe.

Materials and Manner of Fabrications

The containment components (100, 100') may be constructed of a wide range of materials, as may be appropriate for various applications and to meet any applicable regulatory requirements. Among these materials are fiberglass, plastic, steel-reinforced concrete, stainless steel, and aluminum. In one manner of fabrication, a frame of square tube stock is constructed along the edges of the containment component, and panels of metal, such as aluminum, are disposed inside the frame, such as by welding. For such a structure, holes may be drilled in the vertical elements of the frame which define the outer edges of the mating half-panels (102, 103) so that they may be readily bolted to the corresponding vertical elements on the mating containment component.

Pre-cast concrete units would be heavier, requiring more substantial equipment to transport and install them, but also would be more conducive to creation of larger containment cellars.

CONCLUSION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It will be readily recognized by those skilled in the art that the foregoing example embodiments do not define the extent or scope of the present invention, but instead are provided as illustrations of how to make and use at least one embodiment of the invention. The following claims define the extent and scope of at least one invention disclosed herein.

What is claimed is:

1. A modular well containment cellar system comprising:

a bottom portion having at least two edges;

two co-planar half-panels, joined to a first edge of the bottom portion and separated by a through-channel portion between the half-panels;

at least one side wall joined to a second edge of the bottom portion and joined to the half-panels, thereby forming a closed container with an open top for mating to another modular well containment cellar component at the half-panels for receiving a well pipe into the through-channel; and a plurality of drip diverters which divert downward-moving liquid from running between a pair or more of mated half-panels and between the well pipe and the through-channel, thereby avoiding reliance upon sealants or gaskets between mated half-panels;

thereby, the well containment cellar being adapted for installation to a well head in a pair or more of containment components such that dripping and running liquids from above the containment cellar system are captured the well pipe is encased between a pair or more of the mated through-channels, and the well pipe is isolated from exposure to the captured liquids.

2. The system as set forth in claim 1 wherein the second edge of the bottom portion is an arc-like edge, and wherein the side wall comprises a curved wall.

3. The system as set forth in claim 1 wherein the second edge of the bottom portion comprises two or more straight edges, and wherein the side wall comprises two or more flat panels.

4. The system as set forth in claim 3 wherein the second edge of the bottom portion comprises three straight edges, and wherein the side wall comprises three panels.

5. The system as set forth in claim 1 wherein the plurality of drip diverters comprise at least one ridge cap for installation across a pair of top edges of mated half-panels.

6. The system as set forth in claim 1 wherein the plurality of drip diverters comprise at least one drip cone for affixing around the well pipe above the open top of the system, having a sufficient lower diameter to divert running and dripping liquids into the open top and away from top edges of the mating half-panels.

7. The system as set forth in claim 1 wherein one or more of the half-panels, side, wall and bottom portion are joined by frame members.

8. The system as set forth in claim 7 wherein one or more the half-panels, the side wall, and the bottom portion comprises sheet material affixed to the frame members.

9. A method of manufacture of a modular well containment cellar comprising:

forming each of a plurality of containment components by:

providing a bottom portion having at least two edges;

providing two co-planar half-panels, joined to a first edge of the bottom portion and separated by a through-channel portion between the half-panels; and providing at least one side wall joined to a second edge of the bottom portion and joined to the half-panels, thereby forming a closed container with an open top for mating to another containment component at the half-panels for receiving a well pipe into the through-channel; and forming a plurality of drip diverters which, when installed to a well head in a pair or more of containment components, divert downward-moving liquid from running between a pair or more of mated half-panels and between the well pipe and the through-channel, thereby avoiding reliance upon sealants or gaskets between mated half-panels;

thereby, adapting the well containment cellar for installation to a well head in a pair or more of containment components such that dripping and running liquids from above the containment cellar system are captured the well pipe is encased between a pair or more of the mated through-channels, and the well pipe is isolated from exposure to the captured liquids.

10. The method as set forth in claim 9 wherein the second edge of the bottom portion is an arc-like edge, and wherein the side wall comprises a curved wall.

11. The method as set forth in claim 9 wherein the second edge of the bottom portion comprises two or more straight edges, and wherein the side wall comprises two or more flat panels.

12. The method as set forth in claim 11 wherein the second edge of the bottom portion comprises three straight edges, and wherein the side wall comprises three panels.

13. The method as set forth in claim 9 wherein the plurality of drip diverters comprise at least one ridge cap for installation across a pair of top edges of mated half-panels.

14. The method as set forth in claim 9 wherein the plurality of drip diverters comprise at least one drip cone for affixing around the well pipe above the open top of the system, having a sufficient lower diameter to divert running and dripping liquids into the open top and away from top edges of the mating half-panels.

15. The method as set forth in claim 9 wherein one or more of the half-panels, side, wall and bottom portion are joined by frame members.

16. The method as set forth in claim 15 wherein one or more the half-panels, the side wall, and the bottom portion comprises sheet material affixed to the frame members.

17. The method as set forth in claim 9 wherein the half-panels, side, wall and bottom portion comprise one or more materials selected from the group consisting of fiberglass, plastic, steel-reinforced concrete, stainless steel, and aluminum.

* * * * *